US005820573A

United States Patent [19]

Ramos

[11] Patent Number: 5,820,573

[45] Date of Patent: Oct. 13, 1998

[54] BODY CONTOUR MASSAGE DEVICE AND METHOD

[76] Inventor: Grace Marie Ramos, 14 San Felipe Ct., Salinas, Calif. 93901

[21] Appl. No.: 735,200

[22] Filed: Oct. 21, 1996

[51] Int. Cl.[6] ..... A61H 7/00

[52] U.S. Cl. ..... 601/134; 601/146; 5/733; 5/734; 5/944; 5/632; 606/240

[58] Field of Search ..... 601/132–138, 601/143, 146; 5/731, 733, 734, 944, 632; 606/242, 243, 204, 240

[56] References Cited

U.S. PATENT DOCUMENTS

| | | | |
|---|---|---|---|
| 933,170 | 9/1909 | Galbreath | 606/242 |
| 1,533,528 | 4/1925 | Weaver . | |
| 3,705,579 | 12/1972 | Morini . | |
| 3,742,528 | 7/1973 | Munch | 5/733 |
| 3,750,654 | 8/1973 | Shim . | |
| 3,811,140 | 5/1974 | Burpo | 5/632 |
| 3,877,093 | 4/1975 | Gershbein | 5/731 |
| 4,744,351 | 5/1988 | Grundei et al. | 5/944 |
| 4,809,374 | 3/1989 | Saviez | 5/944 X |
| 4,829,614 | 5/1989 | Harper . | |
| 5,165,390 | 11/1992 | Fleetwood . | |
| 5,170,778 | 12/1992 | Jamis . | |
| 5,186,703 | 2/1993 | Huang | 601/134 X |
| 5,195,510 | 3/1993 | Svacina . | |
| 5,327,598 | 7/1994 | Liou . | |
| 5,367,730 | 11/1994 | Sher | 5/632 |
| 5,467,490 | 11/1995 | Rice . | |
| 5,501,658 | 3/1996 | Frye . | |
| 5,524,640 | 6/1996 | Lisak et al. | 5/655 X |

FOREIGN PATENT DOCUMENTS

| | | | |
|---|---|---|---|
| 18840 | 8/1912 | United Kingdom | 601/135 |
| 1410944 | 10/1975 | United Kingdom | 601/134 |

*Primary Examiner*—Danton D. DeMille

[57] ABSTRACT

A massage device disclosed consists of a rigid flat base (30), which when configured with contoured modules (34, 36, 38) and rigid pressure nibs (10, 12, 14) or blades (20, 24, 26, 28) contours the length of an adult human body. The device operates by arranging the massage elements including buttocks, back, shoulder, and neck modules with pressure nibs or blades to match the contoured surface of the backside of person. The person then lies upward facing on the device with massage pressure applied across the entire body for the desired therapeutic effect. The device includes adjustments for body size and shape and therapeutic intensities according to pain relief requirements.

6 Claims, 10 Drawing Sheets

BODY CONTOUR MASSAGE DEVICE AND METHOD

BACKGROUND FIELD OF THE INVENTION

This invention relates to neuromuscular devices, specifically to devices which provide pressure to tissues for deep massage therapy.

BACKGROUND DESCRIPTION OF PRIOR ART

Health product stores and physical therapy offices commonly supply consumers with self help massage devices. Such devices are inadequate for pain relief because they do not provide body-contoured deep pressure. These devices require body motion and are awkward to use for the user who is in pain or has limited range of motion.

Several types of massage devices address the need for home therapy including rolling assisted devices, automated massage tables, and peripheral devices targeted at specific body regions. U.S. Pat. No. 1,533,528 Weaver (1923) provides a device for massage therapy which requires an assistant to create pressure therapy. U.S. Pat. No. 3,705,579 Morini (1972) and U.S. Pat. No. 3,750,654 Shiu (1973) disclose devices composed of bulbous ridges which create pressure to the para-vertebral muscle tissue and require body motion. U.S. Pat. No. 5,170,778 Jamis (1992) discloses a complex rolling device causing deep pressure relief for related neuromuscular conditions. The pressure forces of the above devices are applied to a small region of musculature. These devices do not apply simultaneous pressure to a persons complete body contour.

Massage-table devices exist in U.S. Pat. No. 5,165,390 Fleetwood (1992). In U.S. Pat. No. 5,501,658 Frye (1996) discloses devices which provide therapy from a table with a pivotal roller frame. These devices do not require movement of the user, however, the devices require pivoting roller mechanisms in an elaborate frame which do not apply simultaneous pressure to a persons complete body contour.

A foot-massage mattress exists which provides deep pressure therapy. U.S. Pat. No. 5,327,598 Liou (1994) discloses a device which integrates a foam body and a rigid-vertical members for foot massage. The device is limited to foot therapy and requires the user to stand or walk thereon.

Other peripheral massage devices have been proposed to provide therapy to a specific body region. U.S. Pat. No. 5,467,490 Rice (1995) discloses a neck cradle which provides deep pressure therapy to the cervical spine. The device does not provide pressure to the sides of the neck and does not provide support to the base of the head. U.S. Pat. No. 4,829,614 Harper (1989) discloses an adjustable air pillow with neck support. The use of air chambers does not provide balanced deep pressure therapy for the cervical vertebrae. U.S. Pat. No. 5,195,510 Svacina (1993) discloses a hand-held deep pressure massage device. This device requires the user to move the device over accessible regions of the body. This limits the user's ability to apply pressure to the back or other hard-to-reach areas.

In addition, the peripheral devices noted above do not provide extended pressure to a persons body contour. Providing pressure across the persons body contour in the para-spinal directions will provide simultaneous pressure to muscular tension areas causing the muscle tissue to relax thereby providing relief of pain. This is also known as breaking the pain cycle.

Objects and Advantages

Accordingly, several objects and advantages of the present invention are as follows:

a) To provide deep muscular therapy through non-motion massage.

b) To provide neuromuscular pain relief.

c) To provide cross-fiber manipulation which addresses para-spinal imbalances.

d) To provide firm, adjustable support to normal and abnormal skeletal contours.

e) To provide the benefits of exercise without movement which heightens tissue metabolism, improves circulation and organ function.

Further objects and advantages are to provide a body massage device which can be easily used professionally or at home, which requires no human or mechanical assistance, which requires no electricity, which can be used repeatedly, which provides long lasting relief, which is inexpensive to manufacture, and which can be used by persons of all sizes, shapes, and various health conditions. Still further, objects and advantages will become apparent from a consideration of the ensuing description and drawings.

DRAWING FIGURES

FIGS. 3A, 3B, 3C, and FIG. 3D show various configurations of the body massage device including exploded and assembled views. FIGS. 3E and 3F show configurations of the device in use by adult and child.

Figure 4:
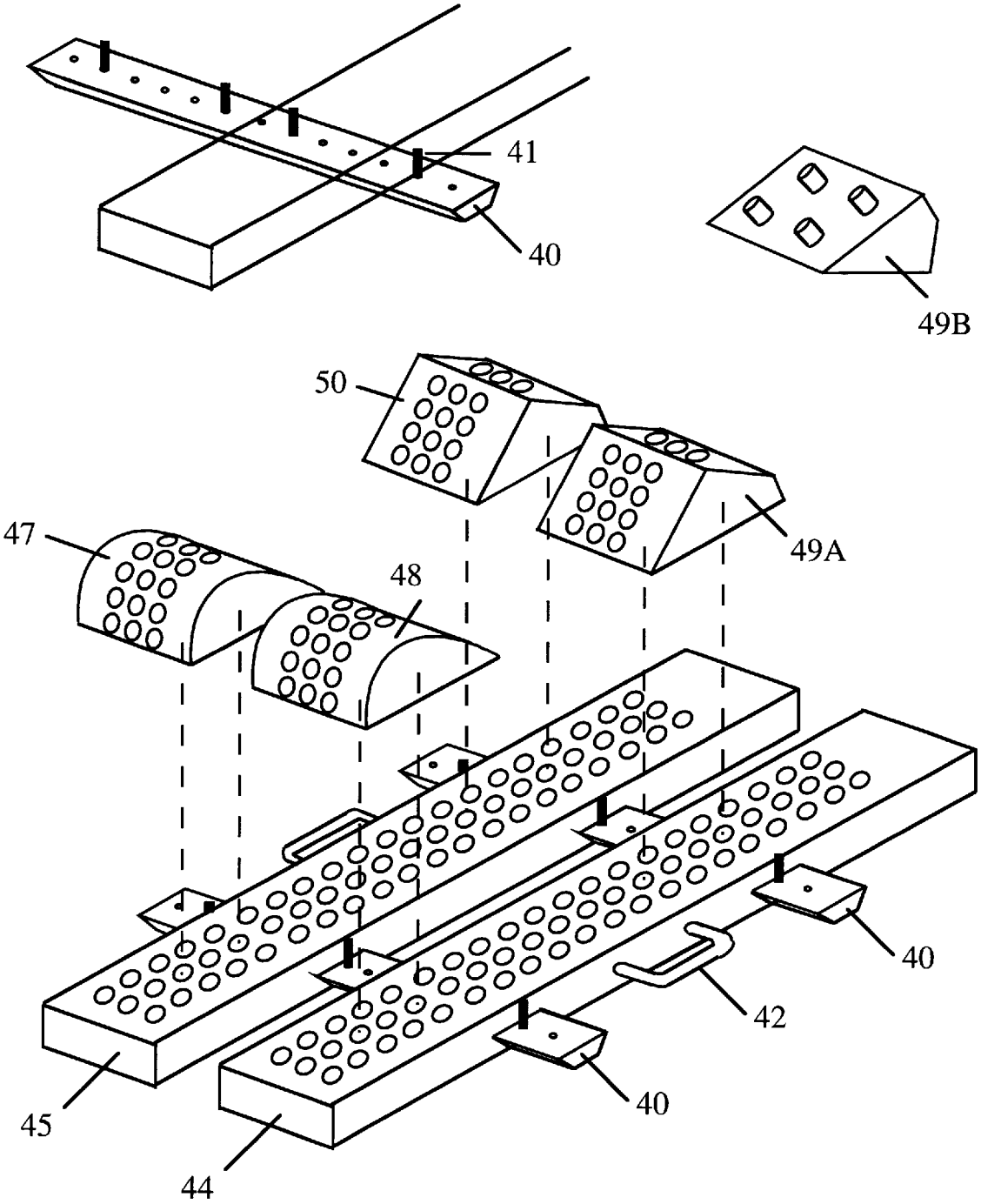

FIG. 4 shows a width-adjustable configurations of the body massage device including sliders, mechanical stops, and handles.

REFERENCE NUMERALS IN DRAWINGS

10 Short Pressure Nib
11 Hook Fastener at bottom of Nib
12 Medium Pressure Nib
13 Loop Fastener at bottom of Nib
14 Tall Pressure Nib
16 Insertion holes
18 Body Contour
20 Narrow Blade
22 Placement Feet
24 Medium Blade
26 Wide Blade
28 Contour Blade
30 Base
34 Buttocks Module
36A Shoulder Module (Top Side)
36B Shoulder Module (Bottom Side)
37 Pillow
38 Neck Module
39A Pelvic Module (Top Side)
39B Pelvic Module (Bottom Side)
40 Slider
41 Mechanical Stops
42 Handle
44 Left Base
45 Right Base
47 Right Buttocks Module
48 Left Buttocks Module
49A Left Shoulder Module (Top Side)
49B Left Shoulder Module (Bottom Side)
50 Right Shoulder Module

SUMMARY

A massage device is described wherein the elements of said device are arranged to contour the back side of a human body and whereby a human lying face up on the device is massaged using non-motion deep pressure. The device includes adjustments and modules to fit all sizes, shapes, and varied health conditions of humans. The pressure is applied to the body surface via point-like pressure from massage pressure nibs or broad pressure from massage blades.

DESCRIPTION—FIGS. 1–4

Figure 1A:
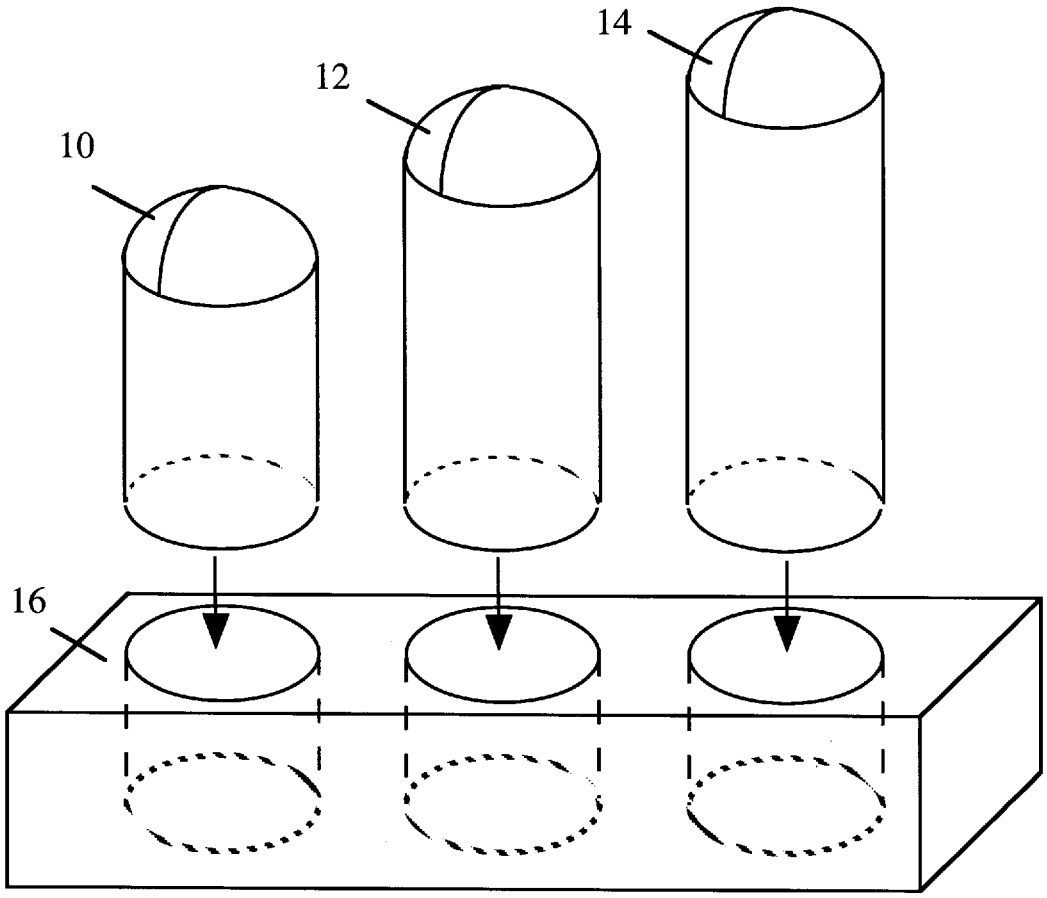
FIGS. 1A and 1B show examples of the various configurations of massage device pressure nibs, their associated insertion holes in a base or module, and the resultant body contour.
Figure 1B:
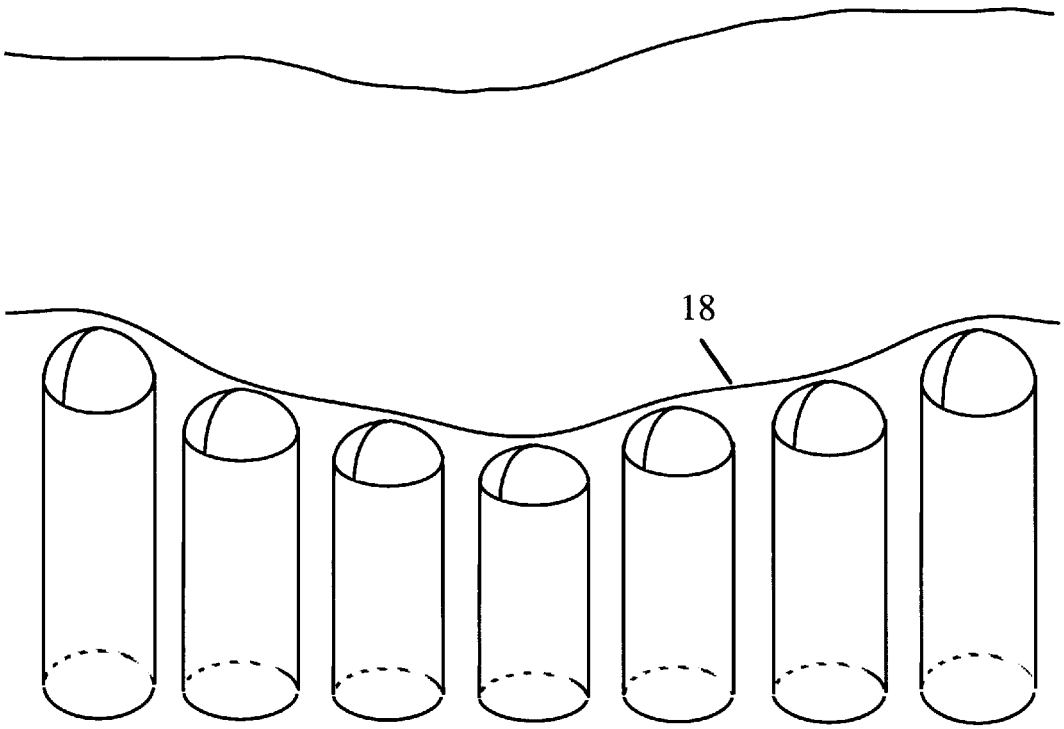

As shown in FIG. 1A, the pressure nibs (10, 12, 14) have cylindrical sides and a semi-spherical top. In this description, the base of the pressure nibs are flat, however, the pressure nibs can consist of any shape which conforms to the bottom surface of the insertion holes and can be fixed to base. Attached to the bottom surface of the pressure nibs are hook-and-loop fasteners. The pressure nib lengths range from 1.5 in. to 3 in. with 0.25 in. increments. In this description, the nibs are color-coded to differentiate each nib length. The diameters of the pressure nibs are about 0.75 in. and are selected to be slightly less than the diameter of the insertion holes in the base (30) and modules (34, 36, 38, 39).

Figure 2:
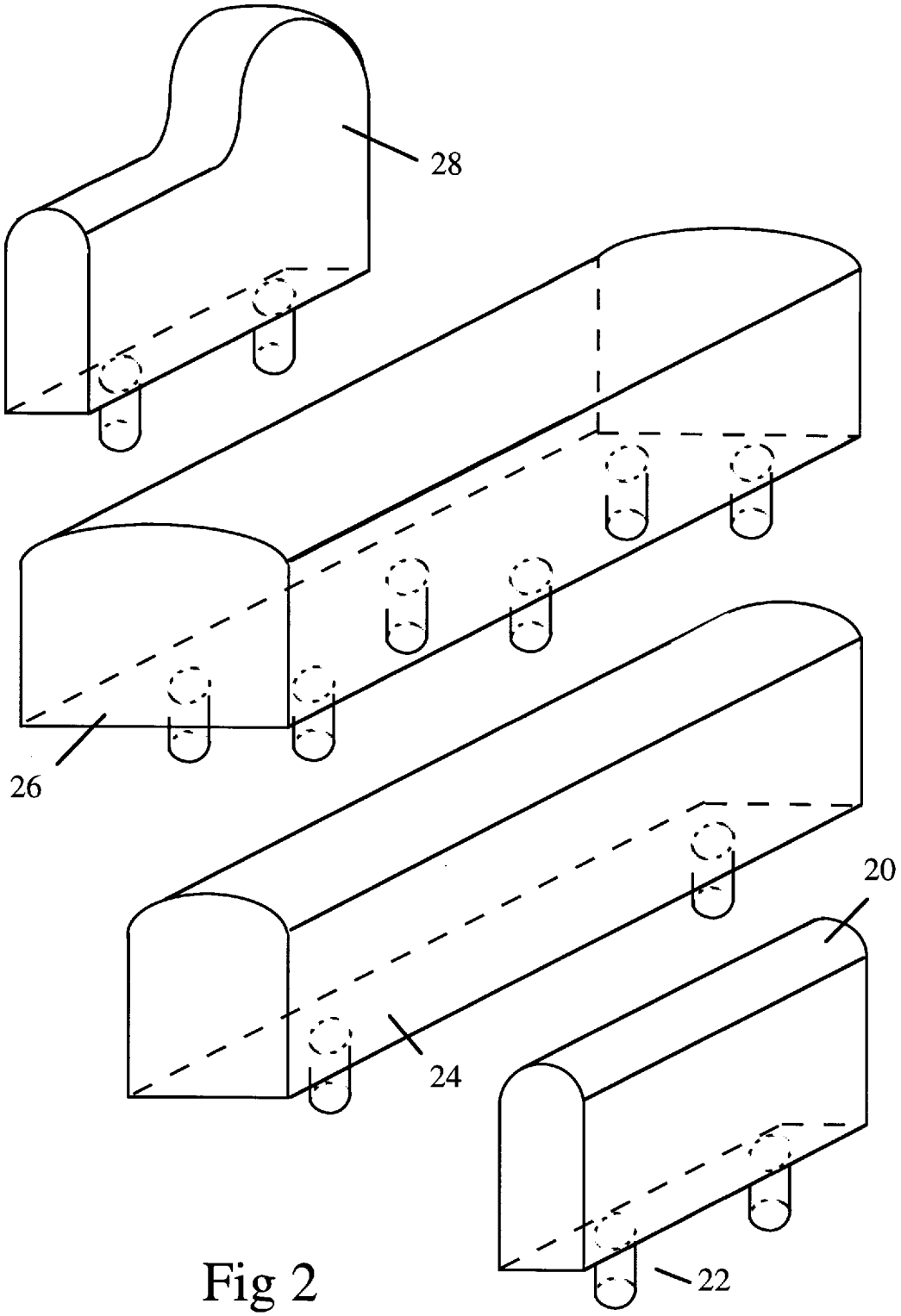
FIG. 2 shows examples of the various configurations of massage device blades.

As shown in FIG. 2, the blades have flat sides and a flat bottom surface. The top surface is contoured with a semi-circular shape from side to side. The heights of the blades are uniform (20, 24, 26) or wave-like (28) and range in height from 1.5 in. to 3 in. The widths of the blades vary from 0.75 in. to 2.75 in. and the lengths of the blades range from 2.75 in. to 18 in. Attached to the bottom surface of the blades are placement feet. These feet are cylindrical with diameter of 0.75 in., extend 0.75 in., are separated by any multiple of the base insertion-hole pattern, and have hook-and-loop fastener material on the bottom surface. In this description, the blades are removable, however, they may be fixed to base or modules.

Typical representations of the invention are illustrated in FIGS. 3A, 3B, 3C, and 3D. The devices include a base (30), which provides a stable platform for the insertion of modules and massage pressure nibs or massage blades. The base is of uniform thickness and may be made of wood. However, the base can consist of any solid or rigid material that conforms to the general shape and supports the modules, pressure nibs, blades, and person under therapy. The base can also be fixed to pressure nibs, blades, modules and any combination thereof.

Typically the base is about 1.5 in. thick 8.5 in. wide and 40 in. long. Width and length dimensions vary according to the human body sizes and can be scaled to fit small infants and large or tall adults. The surfaces of the base are flat and the edges typically rounded for comfort and safety.

Insertion holes are formed on the top surface of the base (16). These holes are approximately 0.75 in. diameter and 0.75 in. deep with the bottom of the hole matching the bottom of the pressure nibs, which in this description are flat. The diameters of the pressure nibs and the insertion-holes are selected so that the pressure nibs may easily slip into the insertion-holes. A hook-and-loop fastener material is used at the junction of the base of the insertion holes and the bottom surface of the pressure nibs, blades and modules. The bottom surface of the pressure nibs, blades, and modules can be fixed to base. The holes are positioned in a grid like pattern with vertical rows that run in the lengthwise direction of the base. A typical base has 2 sets of rows with each set composed of 1, 2, or 3 individual rows. The sets of rows are configured on the base such that each set supports either the right or left half of the body contour. Along the rows, there is typically 0.25 in. between insertion holes, however, there are 0.125 in. between insertion holes for the neck module and for the buttocks or pelvic module the holes can be spaced greater than 1.0 in. The insertion angle of the hole is approximately perpendicular to the top surface of the base. The example device incorporates hook-and-loop material to connect the pressure nibs, blades, and modules within the insertion holes. The hook-and-loop material provides both a retention and cushion effect. The pressure nibs have a slight angular movability when connected to the insertion holes.

Various configurations of the device include the base and sets of modules, pressure nibs, and blades. Each configuration is determined by the contour of the back side of a human and by the desired deep pressure therapy and are further described in FIGS. 3B, 3D, 3E, and 3F. In FIG. 3E the device is configured to support an adult using modules and pressure nibs to provide a body massage for a major portion of the body length. With pressure nibs placed in a single set of rows (FIG. 3B or 3D), the person will experience intense deep pressure therapy. Inserting pressure nibs in the adjacent rows provides broader body support and moderate pressure therapy. Configuring the device with pressure nibs inserted into all the holes provides gentle and broad pressure therapy. The quantity of pressure nibs used in the device as described above, will vary from approximately 50 to over 300 nibs.

For persons whose spinal curvature is straight in nature, the blades (3F) create pressure therapy as an efficient method of simulating multiple-nib pressure therapy. For all therapies, it is recommended that persons lay supine with head positioned on a comfortable pillow (37) as the therapy can create a relaxed state promoting sleep.

Body massage therapies which require pressure at wide positions relative to the spine, should use the adjustable device shown if FIG. 4. The device is similar to those in FIGS. 3A, 3B, 3C, and 3D, with the base unit composed of a left (44) and right (45) half. The halves can be configured to various separations and secured with mechanical stops (41) located on the slider segments (40). Massage modules are also configured to the adjustable base halves (47, 48, 49, 50).

From the description above, a number of advantages of my body contour massage device become evident:

(a) Deep pressure massage therapy is provided across a majority of the body contour using a simple, self-contained device.

(b) The device can be easily configured to provide massage to most body shapes and sizes.

c) The device requires no body motion to perform therapy.

OPERATION—FIGS. 3A, 3B, 3E, 3F

The following instructions may be used to position the body onto therapeutic contoured surfaces as shown in FIG. 3E. The manner of using the body massage device is similar to positioning a human body on a firm bed.

To configure the body massage device:

(1) Place the base (30) on a flat surface.

Figure 3A:
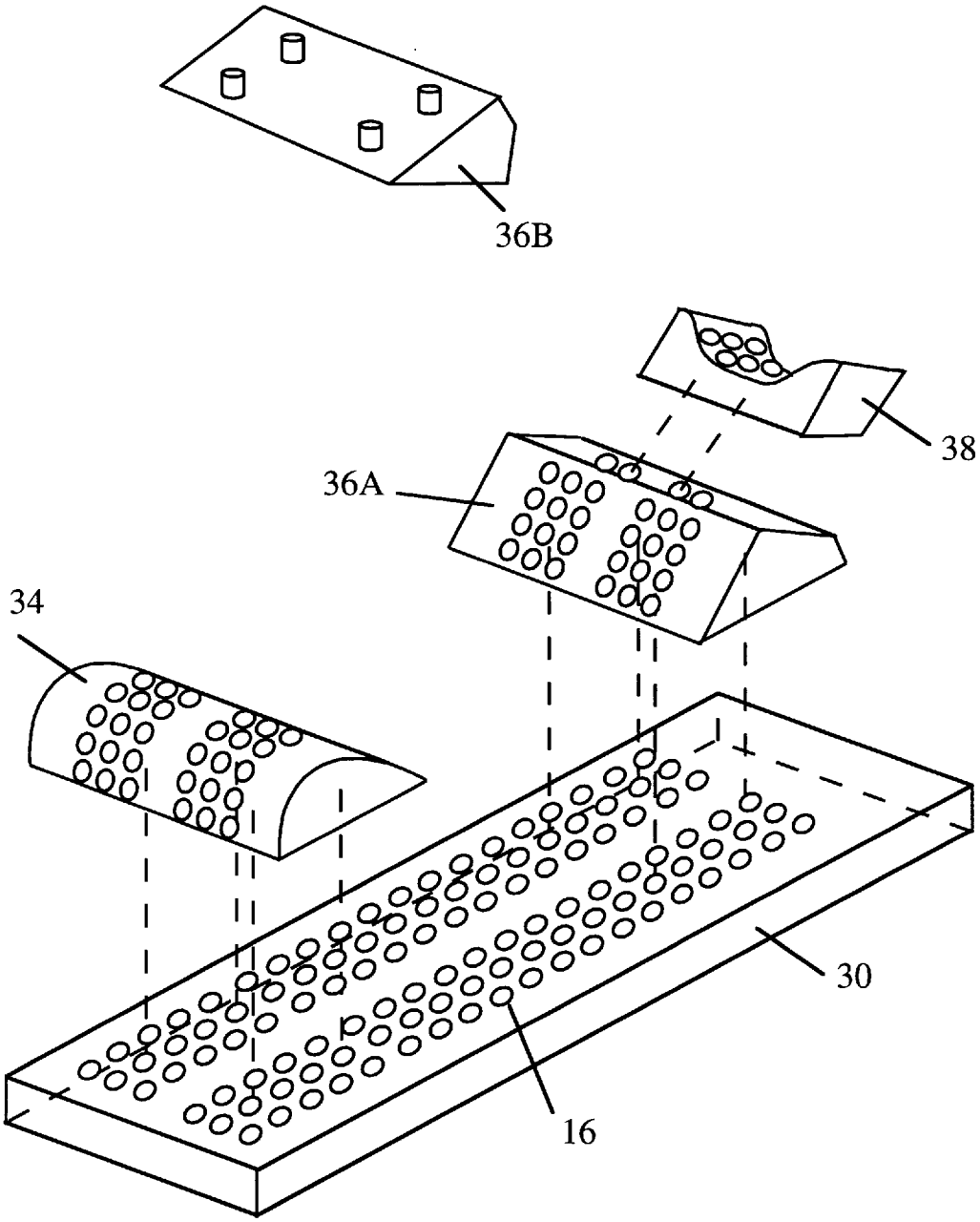

(2) Attach the neck module (38) to the shoulder module (36) as shown in FIG. 3A. If cranial therapy is not desired, the body massage device can be used without the neck module as shown in FIG. 3F.

(3) Attach the shoulder module (36) to base (30) near the head end.

(4) Position pillow (37) to support back of head near the neck module (38).

(5) Lie face up on the device and slide buttocks module (34) under the buttocks and attach to the base (30).

(6) Dismount the device.

Figure 3B:
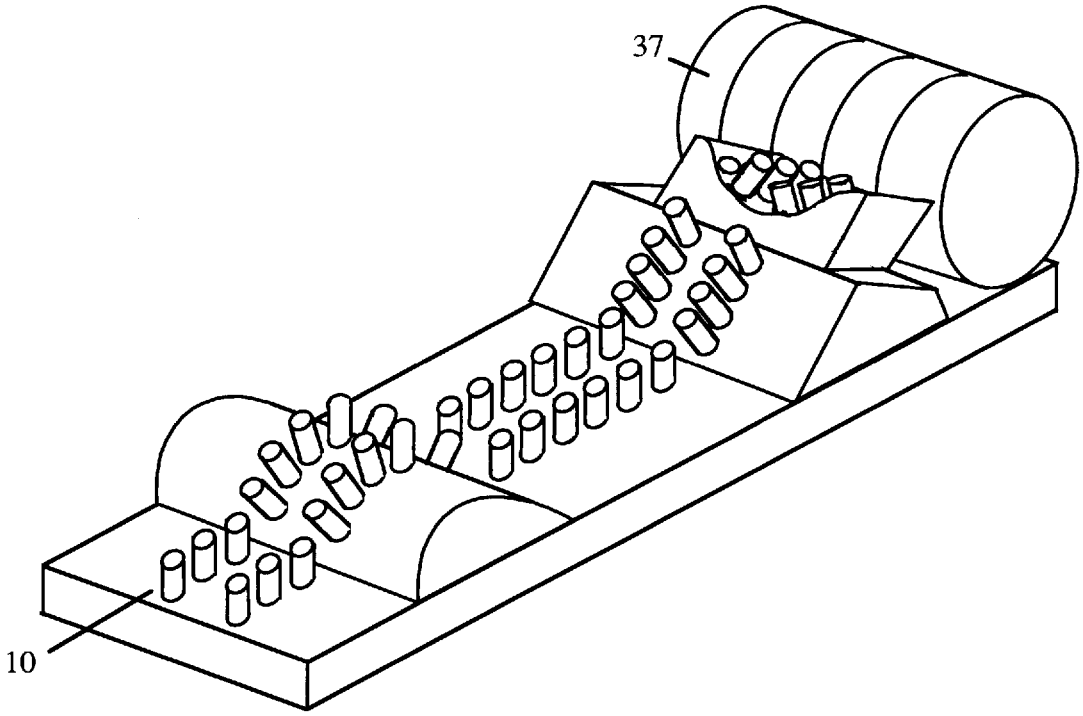
Figure 3C:
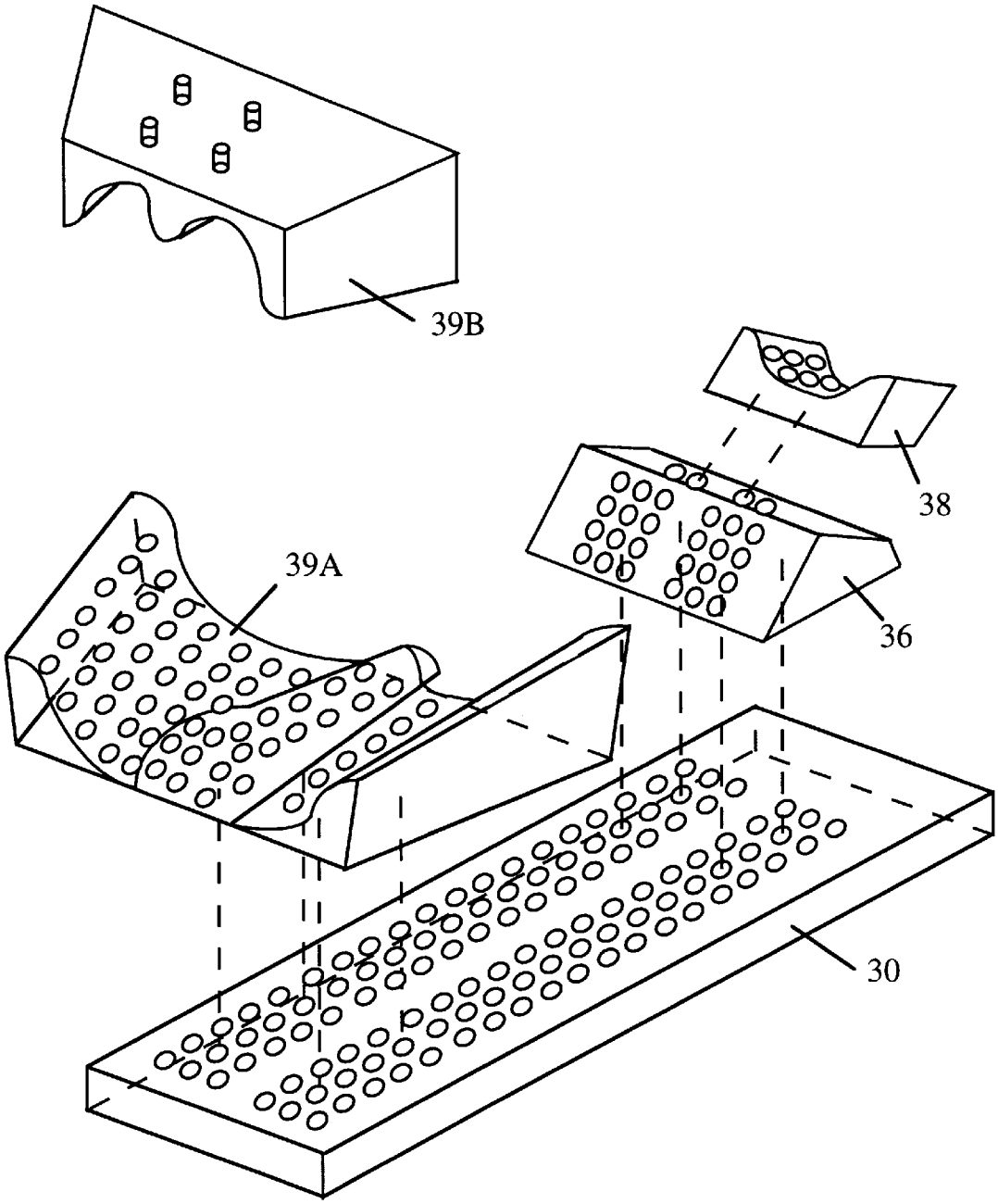
Figure 3D:
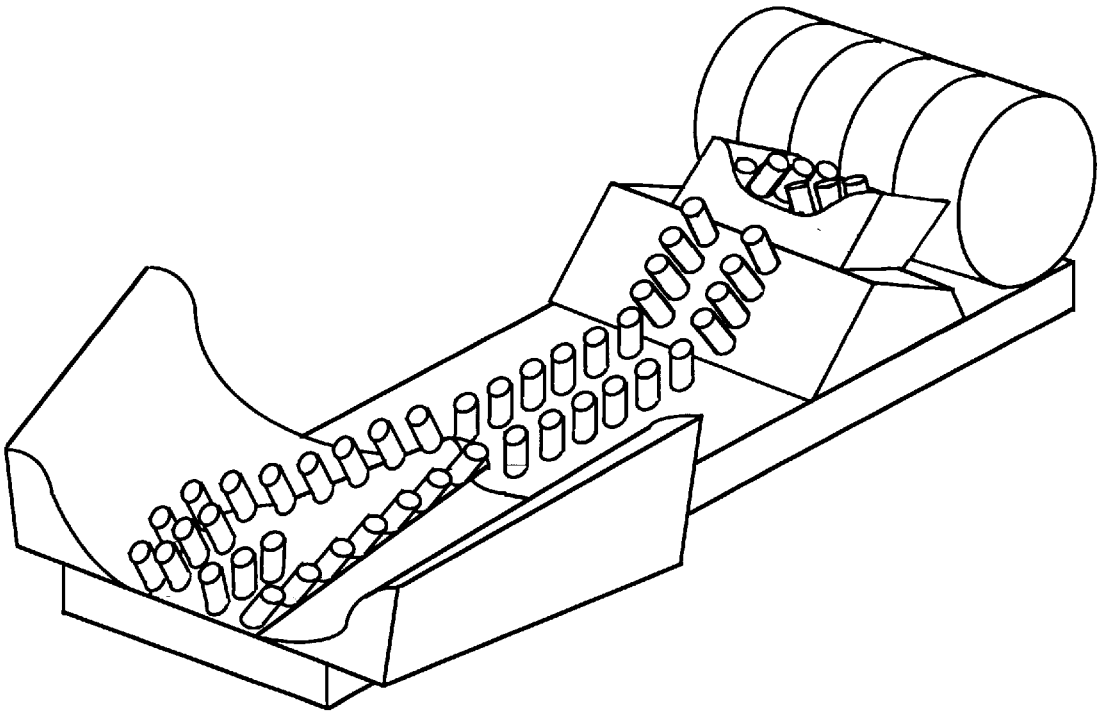
Figure 3E:
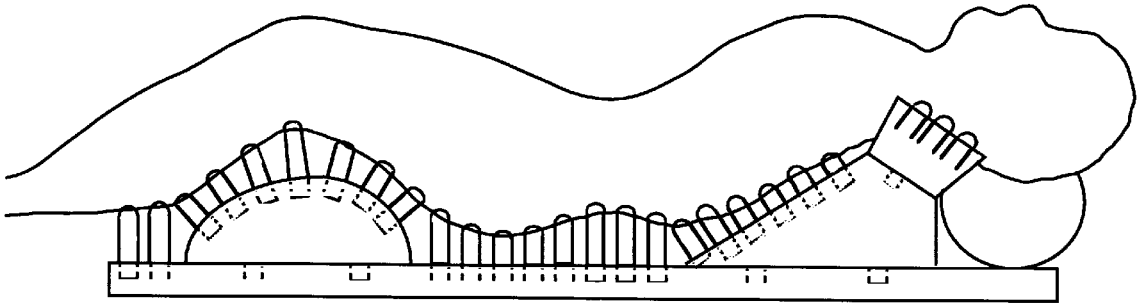
Figure 3F:
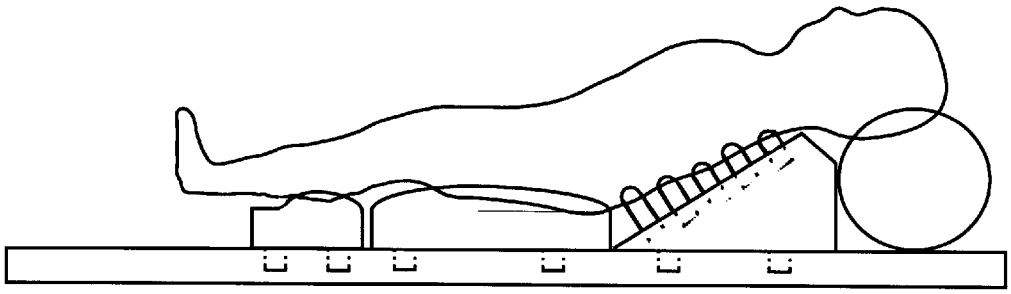

(7) Place pressure nibs (10) into holes of shoulder module, buttocks module, and base as shown in FIG. 3B. Select appropriate pressure according to the type of therapy as described below.

(8) For all therapies, lie face up on device and rest.

Pressure nib lengths may be selected such that when inserted into holes, they contour to the body as shown in FIG. 3E. Pressure nibs (10, 12, 14) or blades (20, 24, 26, 28), may be interchanged in order to provide suitable contour coverage as shown in FIG. 3F. Long pressure nibs will provide greater pressure. Wide or long blades will provide the least pressure to body surface.

Body massage pressure intensity configurations are as follows:

For intense pressure—install two single rows of pressure nibs or blades closest to the longitudinal center line of the base.

For moderate pressure—install two double rows of pressure nibs or blades closest to the longitudinal center line of the base.

For light pressure—install pressure nibs or blades in all rows provided. The nibs, which can be configured individually, allow for minute adjustments, which are ideal for persons with severe spinal curvature. The blades will act as a combination of pressure nibs to provide broader and lighter pressure across a greater surface area.

Conclusion, Ramifications, and Scope

Accordingly, the reader will see that the benefits of the body contour massage device are numerous. This invention, which requires no body motion, can be used easily and conveniently. It serves a vast need for therapy to persons of all sizes, ages, and health conditions. It addresses the pain cycle offering lasting relief and corrects neuromuscular disorders.

It provides contoured pressure to a persons musculature, applies pressure to a persons para-spinals, and provides simultaneous pressure across the body causing dramatically increased blood flow which creates immediate relief for muscle tissue as well as relief of pain.

It provides a firm adjustable support through the multiple configurations of modules, pressure nibs, and blades to normal and abnormal body contours.

It provides exercise benefits to those persons who because of injury, illness, or age, are inactive.

It is a massage device which is simple to set up, easy to use, and requires no body motion for therapy.

It provides a complete range of pressure therapy which can vary from extreme pressure using point-pressure from nibs to moderate or light pressures using a combination of nib or blade configurations which are applied to extended body contours.

It allows for the increase of blood flow to vital organs heightening the body's tissue metabolism and thus acting as a mechanical cleanser for the lymphatic system.

It decreases edema, decreases tendencies towards fibrosis while increasing flexibility, decreases spasms, decreases undesired adhesions, decreases musculature pain, aids in fracture healing, increases body awareness, increases retention of nitrogen, sulfur and phosphorous.

Although the above description contains many specificity's, these should not be construed as limiting the scope of the invention since the device also addresses the vascular, lymphatic, muscular, and skeletal systems. For example the vascular system is effected through increased blood flow, increased red blood count, normalized blood pressure, increased systolic stroke volume, and decreased pulse rate creating a calm, peaceful wellness.

Thus the scope of the invention should be determined by the appended claims and their legal equivalence, rather than by the examples given.

I claim:

1. A body contour massage device which provides simultaneous pressure to the paraspinal regions of the back as therapy for people with excessive spinal curvature, comprising:

(a) a rigid base, and (b) one or more rows of rounded-top pressure nibs which graduate in height and have non-rounded ends wherein the length of said base is at least sufficient to extend from the base of the neck of a human to the top of the legs of a human and wherein said nibs reside in flat-bottomed holes in said base and where the non-rounded ends of said nibs are flat and removably connected to said base by means of hook and loop fasteners and wherein the lengths of said nibs are selected to provide a contour of said rounded-tops which is similar to the contour of the spine and with said hook and loop fastener materials which provide a cushion-like affect and allow the nibs to perform slight angular-tilting moveabilities in response to the gravitational forces of a human resting thereon.

2. The body contour massage device of claim 1 wherein said base can be divided in sections.

3. The body contour massage device of claim 1 with at least one module having a flat lower surface with protruding placement feet inserted into the holes of said base with hook and loop fasteners and an upper contoured surface with a plurality of insertion holes, whereby said nibs are inserted in the holes of said base or said module and the configuration of said massage device contours a segment of the back side of a resting supine human.

4. The body contour massage device of claim 3 whereby said nibs, modules, and base are one unit and the configuration of said massage device contours a segment of the backside of a resting supine human.

5. A body contour massage device of claim 1 wherein said base is separated along a longitudinal line into two half-devices and are connected by at least one rigid perpendicular cross member and is slideably attached to said half-devices and allows a variable separation of said half-devices.

6. A method of para-spinal back therapy, comprised of the application of said body device of claim 1 to provide the simultaneous application of pressure to a multitude of muscles adjacent to the spine of the backside of a resting supine human.

* * * * *